United States Patent [19]

Karlotski et al.

[11] 4,310,774

[45] Jan. 12, 1982

[54] ARC DISCHARGE LAMP CONTAINING SCANDIUM AND SCANDIUM HALIDE

[75] Inventors: Robert J. Karlotski, Weare, N.H.; Dale E. Work, Topsfield, Mass.

[73] Assignee: GTE Products Corporation, Stamford, Conn.

[21] Appl. No.: 126,780

[22] Filed: Mar. 3, 1980

[51] Int. Cl.[3] ..... H01J 61/18

[52] U.S. Cl. ..... 313/228; 313/225; 313/229

[58] Field of Search ..... 313/223-229, 313/184

[56] References Cited

U.S. PATENT DOCUMENTS

| | | | |
|---|---|---|---|
| 3,234,421 | 2/1966 | Reiling | 313/229 X |
| 3,351,798 | 11/1967 | Bauer | 313/225 |
| 3,398,312 | 8/1968 | Edris et al. | 313/225 |
| 3,407,327 | 10/1968 | Koury et al. | 313/227 X |
| 3,577,029 | 5/1971 | Koury | 313/184 X |
| 3,911,308 | 10/1975 | Akutsu et al. | 313/184 |
| 3,979,624 | 9/1976 | Liu et al. | 313/225 X |
| 4,247,798 | 1/1981 | Howe et al. | 313/225 |

*Primary Examiner*—Marvin L. Nussbaum
*Attorney, Agent, or Firm*—James Theodosopoulos

[57] ABSTRACT

A metal halide arc discharge lamp comprises an arc tube having electrodes at its ends and containing a fill including mercury, a starting gas, elemental scandium and at least about $2.6\times10^{-6}$ gram atoms of scandium halide and $3.0\times10^{-5}$ gram atoms of sodium halide per centimeter of arc length.

1 Claim, 1 Drawing Figure

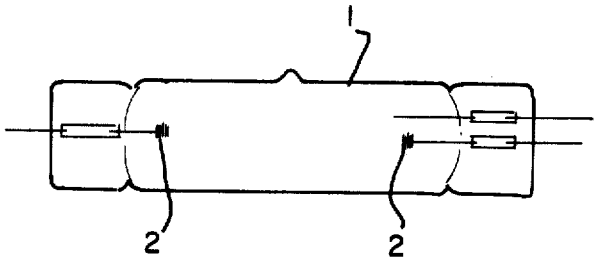
1
2
2

ARC DISCHARGE LAMP CONTAINING SCANDIUM AND SCANDIUM HALIDE

TECHNICAL FIELD

This invention is concerned with metal halide arc discharge lamps having an arc tube fill that includes scandium.

BACKGROUND ART

Scandium may be included in the arc tube fill of a metal halide arc discharge lamp either as the halide or in elemental form. U.S. Pat. Nos. 3,351,798 and 3,979,624 disclose its use in halide form and U.S. Pat. No. 3,407,327 discloses its use in elemental form, while U.S. Pat. No. 3,577,029 discloses its use in either form and U.S. Pat. No. 3,911,308 discloses its use in both forms.

DISCLOSURE OF THE INVENTION

Scandium is often included in the arc tube fill of a metal halide arc discharge lamp because of its white color emission. It is often added in halide form, for example, as scandium iodide. A disadvantage to its use as the halide alone is a reduction in luminous flux and maintenance as compared to the use of scandium in elemental form. For example, 175 watt lamps containing elemental scandium, as well as scandium iodide, produced 13,400 lumens and had a maintenance at 2000 hours of 82.8% while the same lamps containing scandium iodide without metallic scandium only produce 11,000 lumens and had a maintenance at 2000 hours of 61.8%.

However, there is a disadvantage to the use of elemental scandium, the disadvantage being that it results in increasing lamp voltage during life, which can result in premature failure.

We have found that the problem of increasing lamp voltage in lamps containing elemental scandium can be alleviated by adding a predetermined minimum quality of scandium halide and sodium halide, said minimum quantity being about $2.6\times10^{-6}$ gram atoms of scandium halide per centimeter of arc length and about $3.0\times10^{-5}$ gram atoms of sodium halide per centimeter of arc length. Prior art metal halide arc discharge lamps having a fill that included both elemental scandium and scandium halide, as well as sodium halide, contained less than said predetermined minimum quantity of scandium halide and sodium halide. Said prior art lamps also had a voltage rise, after 4000 hours of normal lamp operation, greater than 20 volts.

Metal halide lamps in accordance with this invention are of the usual construction for such lamps, that is to say, the lamp comprises a fused silica arc tube having electrodes at its ends and containing a fill including, in addition to the scandium and scandium halide and sodium halide which have been previously mentioned, mercury and a starting gas, for example, argon. The fill may also include other metal halides for example, cesium halide.

The drawing shows a lamp in accordance with this invention.

In a specific example, a 175 watt metal halide lamp, having a nominal operating voltage of 130 volts, comprised a fused silica arc tube 1 having an outer diameter of 15 mm and an arc length, that is to say, a distance between electrodes 2, of 26 mm. The arc tube fill included mercury, argon, a small chip of scandium metal and a small amount of cesium iodide. In a lamp as per this invention the fill also included 11.52 milligrams of sodium iodide and 2.88 milligrams of scandium iodide, wich quantities are equivalent to $3.0\times10^{-5}$ gram atoms of sodium iodide per centimeter of arc length and $2.6\times10^{-6}$ gram atoms of scandium iodide per centimeter of arc length. Lamps containing such quantities of sodium iodide and scandium iodide had a volting rise, after 4000 hours of normal lamp operation, less than 20 volts. In one text of ten such lamps, the 4000 hour voltage rise was only two volts. In contrast, the prior art 175 watt metal halide lamp, which contained the same fill except that the quantities of sodium iodide and scandium iodide were respectively only $1.5\times10^{-5}$ and $1.3\times10^{-6}$ gram atoms per centimeter of arc length, had a voltage rise, after 4000 hours of normal lamp operation, of 23 volts.

We claim:

1. A metal halide arc discharge lamp comprising an arc tube having electrodes at its ends and containing a fill including mercury, a starting gas, elemental scandium, scandium halide and sodium halide, the quantity of scandium halide being a least $2.6\times10^{-6}$ gram atoms per centimeter of arc length, the quantity of sodium halide being at least $3.0\times10^{-5}$ gram atoms per centimeter of arc length, the voltage rise of the lamp after 4000 hours of normal operation being less than 20 volts.

* * * * *